US007783057B2

(12) United States Patent
Park

(10) Patent No.: US 7,783,057 B2
(45) Date of Patent: Aug. 24, 2010

(54) MUSIC PLAY CONTROL APPARATUS USING AT LEAST ONE EARPHONE FUNCTION KEY AND METHOD THEREOF

(75) Inventor: Choun Woo Park, Suwon-si (KR)

(73) Assignee: LG Electronics Inc., Seoul (KR)

( * ) Notice: Subject to any disclaimer, the term of this patent is extended or adjusted under 35 U.S.C. 154(b) by 1176 days.

(21) Appl. No.: 11/124,146

(22) Filed: May 9, 2005

(65) Prior Publication Data

US 2006/0009868 A1 Jan. 12, 2006

(30) Foreign Application Priority Data

Jul. 8, 2004 (KR) ..... 10-2004-0052882
Nov. 5, 2004 (KR) ..... 10-2004-0089661

(51) Int. Cl.
*H04R 1/10* (2006.01)
*H04R 25/00* (2006.01)
*H04R 5/02* (2006.01)

(52) U.S. Cl. ..... 381/74; 381/309; 381/384

(58) Field of Classification Search ..... 381/74, 381/77, 309, 370, 376, 384; 700/94
See application file for complete search history.

(56) References Cited

U.S. PATENT DOCUMENTS 5,420,739 A * 5/1995 Yokozawa et al. ..... 360/137
5,794,127 A * 8/1998 Lansang ..... 455/66.1
6,301,513 B1 * 10/2001 Divon et al. ..... 700/94
6,879,843 B1 * 4/2005 Kim ..... 455/557
7,283,880 B2 * 10/2007 Dick ..... 700/94
7,340,284 B2 * 3/2008 Chung ..... 455/569.1

FOREIGN PATENT DOCUMENTS

JP 2001-057695 2/2001

* cited by examiner

*Primary Examiner*—Ping Lee
(74) *Attorney, Agent, or Firm*—KED & Associates LLP

(57) ABSTRACT

A music play control apparatus and method for a music player using at least one earphone function key are provided which are capable of performing a music play control operation of the music player using earphones. In the music play control apparatus and method, an external key input from left/right function keys installed on the earphones is scanned. If a key signal is input from either the left or right function key, a value of the input function key is recognized and a music play control operation is performed by a predetermined function depending on the recognized function key value.

16 Claims, 12 Drawing Sheets

MUSIC PLAY CONTROL APPARATUS USING AT LEAST ONE EARPHONE FUNCTION KEY AND METHOD THEREOF

BACKGROUND OF THE INVENTION

1. Field of the Invention

The invention relates to a music player, and more particularly, to a music play control apparatus using at least one earphone function key and a method thereof.

2. Background of the Related Art

Moving picture experts group (MPEG) means moving image and multimedia experts group. Experts of a related field have gathered under an international standard organization, such as an International Standardization Organization (ISO) and International Electro-technical Commission (IEC), and established the MPEG, which provides technical standards regarding compressing, transmitting, and recovering video and audio signals. MP3 means an MPEG-1 Audio Layer-3, which is one of the audio parts of the MPEG technology. It is possible to reduce audio sound information up to one twelfth by applying MPEG audio compression technology.

Development in scientific technology and digital audio data processing technology has made it possible to provide a memory device capable of accumulating sound data (namely, audio sound information) in a portable digital audio player, such as an MP3 player, as well as a sound storage medium, such as a cassette tape. Since a memory device mounted inside of an MP3 player has been widely used recently, it is possible to play sound data for a long time without deterioration in sound quality, even without separate insertion of a related art sound accumulation medium.

FIG. 1 is a block diagram of a related art portable audio player or MP3 player. As illustrated in FIG. 1, the related art MP3 player includes a key input unit 15, a display unit 20, a power supply unit 25, a controller 30, a decoder 35, a digital-to-analog converter (DAC) 40, an audio output unit 45, and an earphone jack 50.

The key input unit 15 is used to input various keys for system operation and playing music. The display unit 20 displays music file recognition information of a MP3 storage unit 55, music file information in playing (for example, title, playing time, sequence number of a relevant music), and an operation status of the MP3 player. Information that will be displayed on the display unit 20 is determined based on the functions that the MP3 player supports. Among the information on the operable functions of the MP3 player, all information required to inform a user may be displayed.

The power supply unit 25 provides power necessary for performing a normal operation. The power supply unit 25 may be a portable power supply, such as a rechargeable battery, a non-rechargeable battery, or an adaptor connector for applying operation power from an external power source.

The controller 30 controls the whole system in order to control music play. For example, the controller 30 controls the key input unit 15, the display unit 20, the decoder 35, and the MP3 storage unit 55 so that an MP3 file selected through the key input unit 15 by a user operation may be output through the earphone jack 50.

The decoder 35 reads and decodes information of an MP3 file stored in the MP3 storage unit 55 and generates audio digital data under control of the controller 30. The DAC 40 converts the audio digital data generated by the decoder 35 into audio analog data. The audio output unit 45 amplifies and normalizes the audio analog data received from the DAC 40 and delivers the amplified audio analog data so that a user may listen to sound data in its optimum condition using an earphone assembly (not shown) connected with the earphone jack 50.

FIG. 2 is a perspective view of a related art portable audio player. As illustrated in FIG. 2, the audio player 1 has on its front side a display unit 20 for displaying a variety of functions and play information, and has on its lower side a plurality of key input units 15.

The key input unit 15 includes a play button 10, buttons 11 for controlling playing and searching speeds, to be, for example, fast or slow, a stop button 12, a pause button 13, a volume button 14, a hold switch 9, a menu button 18, and a record button 16. Here, the play button 10 includes a power-on/off function and a play function depending on a pressing time.

In the audio player 1, a button exposed to the outside, for example, a play button, may be frequently pressed unnecessarily. That is, the audio player 1 is carried in a pocket or a bag while moving, and then an earphone assembly 2 is connected to the earphone jack 50 for listening to the music through left/right earphones 52 and 53. The button is maintained in a hold state using the hold switch 9.

However, since the earphones 52 and 53, and the player 1 are generally used a predetermined distance apart, there exists inconvenience in controlling a volume or a music skip function of a remote controller or the keys in the main bodies while exercising or moving.

SUMMARY OF THE INVENTION

An object of the invention is to solve at least the above problems and/or disadvantages and to provide at least the advantages described hereinafter.

The music play control apparatus according to embodiments of the invention provides function keys on earphones and performs various music play controls of the music player using the earphone function keys.

To achieve these objects, in whole or in part, and in accordance with the purposes of the invention, as embodied and broadly described herein, there is provided a music control apparatus for a music player in accordance with an embodiment of the invention that includes an earphone having an earphone jack one end of which is connected with the music player, at least one earphone main body line-connected with the earphone jack and configured to output an audio signal delivered through the earphone jack, and at least one function key installed on the earphone main body and to which a key signal for controlling a music play depending on a user section is input, and an earphone function controller included in the music player, configured to receive a signal input from the at least one function key of the earphone main body, and perform a music play control operation after recognizing the received signal.

To further achieve these objects, in whole or in part, and in accordance with the purposes of the invention, as embodied and broadly described herein, there is provided an earphone apparatus for a music player in accordance with an embodiment of the invention that includes at least one earphone main body, the at least one earphone main body comprising at least one function key configured to communicate with a controller of the music player, an earphone line in audio communication with the at least one ear phone main body, and an earphone jack connected to the earphone line.

To further achieve these objects, in whole or in part, and in accordance with the purposes of the invention, as embodied and broadly described herein, there is provided a music play control method using at least one earphone function key in a music player in accordance with an embodiment of the invention that includes scanning an external key input from at least one function key installed on at least one earphone main body, if a key signal is input from the at least one function key, recognizing a value of the input function key, and performing a music play control operation using a predetermined function depending on the recognized value of the at least one function key.

To further achieve these objects, in whole or in part, and in accordance with the purposes of the invention, as embodied and broadly described herein, there is provided a music play control method using at least one earphone function key in a music player in accordance with an embodiment of the invention that includes scanning an external key input from the at least one function key installed on at least one earphone main body, if a key signal is input from the at least one function key, recognizing a value of the function key, and performing a music play control using a predetermined function depending on the recognized value of the function key.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Now, a music player control apparatus for a music play using at least one earphone function key and method thereof according to embodiments of the invention will be described in detail with reference to the drawings, in which like reference numbers have been used to designate like elements.

Figure 1:
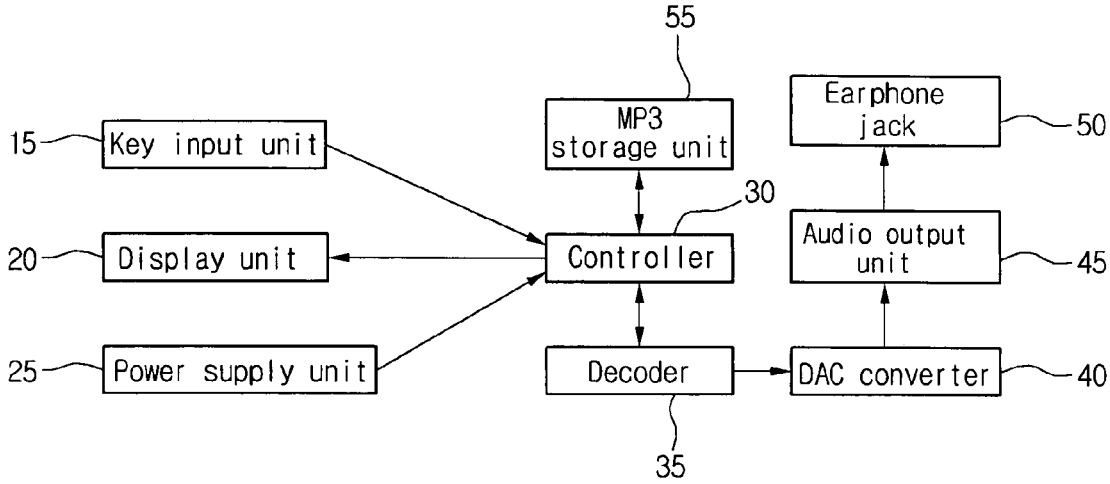
FIG.1 (Related Art)
FIG. 1 is a block diagram of a related art music player.
Figure 2:
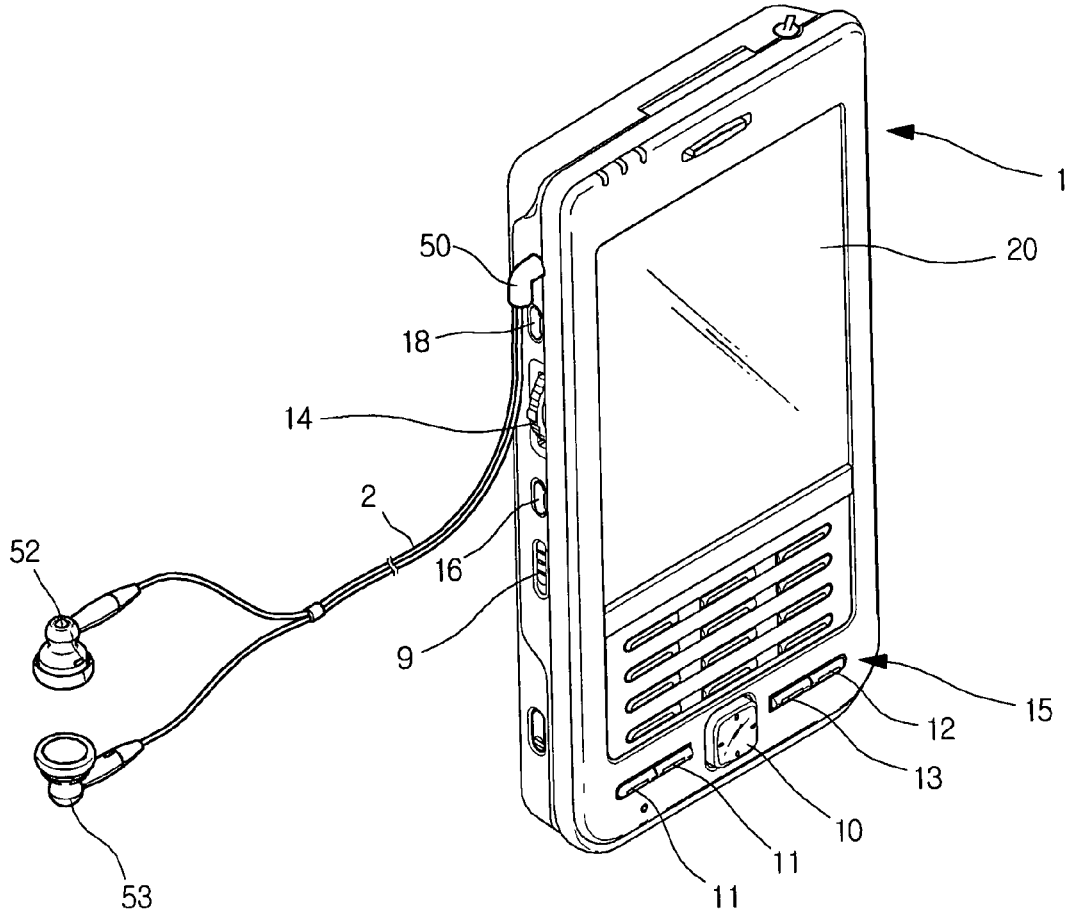
FIG.2 (Related Art)
FIG. 2 is a front perspective view of a related art music player.
Figure 3:
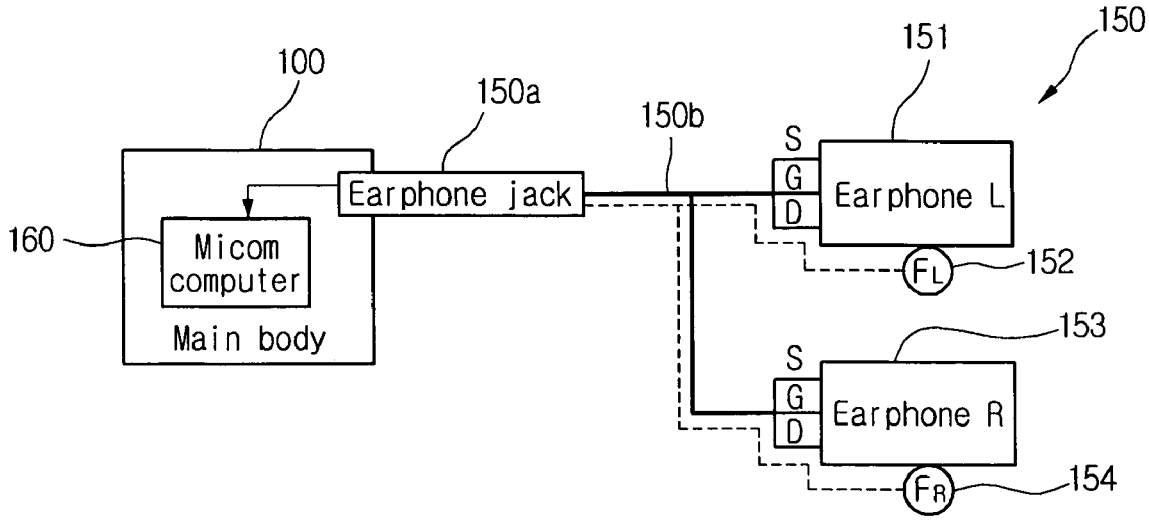
FIG. 3 is a block diagram of a music play control apparatus for a music player using at least one earphone function key according to an embodiment of the invention.
Figure 4:
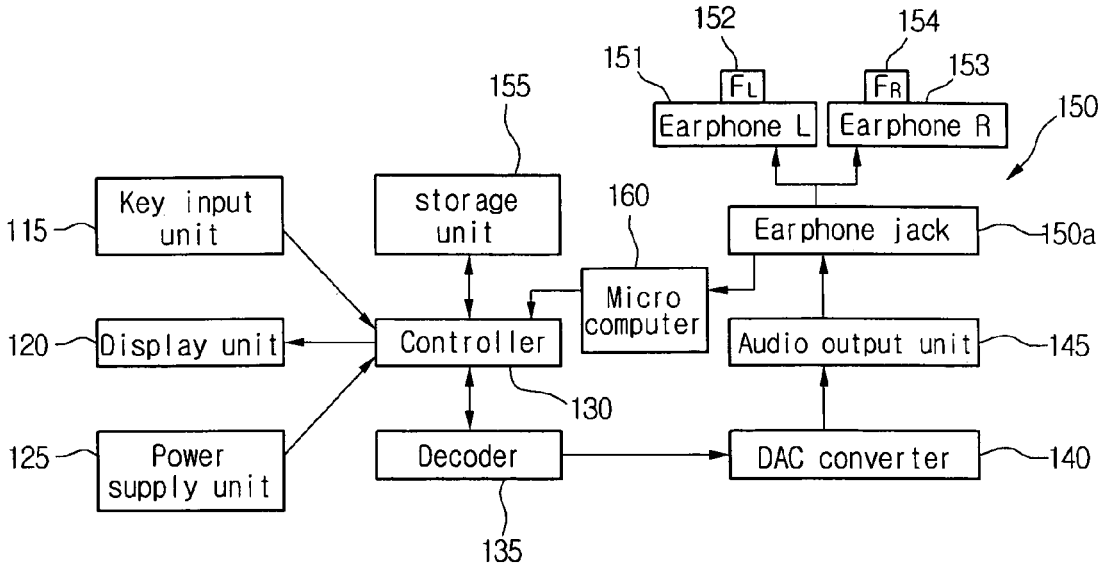
FIG. 4 is a block diagram of a music player according to an embodiment of the invention.

FIG. 3 is a block diagram illustrating a connection construction between an earphone apparatus or assembly (hereinafter, referred to as "earphone") and a main body of a music play control apparatus using at least one earphone function key according to an embodiment of the invention. FIG. 4 is a block diagram of a music player according to an embodiment of the invention.

Referring to FIGS. 3 and 4, a main body 100 of a portable music player may include a microcomputer 160 with an earphone 150 connected thereto. The earphone 150 may include an earphone jack 150*a*, left/right earphone main bodies 151 and 153, and left/right function keys $F_L$ 152 and $F_R$ 154.

The earphone jack 150*a* may be connected to the earphone main bodies 151 and 153 by an earphone line 150*b*. The earphone jack 150*a* may be attached to/detached from an earphone jack connection terminal (not shown) on the main body 100 and the left/right earphone main bodies 151 and 153 may output an audio signal delivered through the earphone jack 150*a*.

The left/right function keys 152 and 154 may be installed at an arbitrary position on the left/right earphone main bodies 151 and 153. For example, function keys 152 and 154 may be installed at a predetermined position on a rear side or an outer periphery of the earphone main bodies 151 and 153 for key selection by a user. Further, the function keys 152 and 154 may be in the form of, for example, an inverter key or a toggle key.

The earphone line 150*b*, which connects the earphone jack 150*a* with the earphone main bodies 151 and 153, may include, for example, a signal line (S: signal), a ground terminal (G: GND), and a data line (D: data line) for delivering a signal from the function keys 152 and 154. The main body 100 may include a microcomputer 160 configured to receive a selection signal from the left/right function keys 152 and 154. The microcomputer 160 may have ports (not shown) that receive signals from the left/right function keys 152 and 154 and may contain a program for discriminating signals from the left/right function keys 152 and 154 selected by a user.

The microcomputer 160 may include additional functions for controlling a music play using the left/right function keys 152 and 154. For example, the microcomputer 160 may include one or more functions, such as a play/stop function, a forward/backward skip function, a volume increase/decrease function, an interval-repeat-play start/termination point setting function, and a mute/pause function.

The main body 100 may also include a storage unit 155, such as a MP3 storage unit, a controller 130, a decoder 135, a digital to analog connector (DAC) 140, an audio output unit 145, and the microcomputer 160. The controller 130 may interface a key input unit 115 and a display unit 120. A power supply unit 125 supplies power to each unit of the system.

Operation of the music play control apparatus using at least one earphone function key in accordance with embodiments of the invention will now be described.

First, if the earphone jack 150 is connected with the main body 100, the main body recognizes the connection of the earphone jack 150. Next, if a specific function key 152 or 154 on the earphone main bodies 151 or 153 is selected by a user, the microcomputer 160 confirms an input of the specific function key through an external key input scan, recognizes the confirmed key value and then delivers it to the controller 130, thereby performing a music play control operation.

For example, if the left or right function key 152 or 154 is selected, a music file may be selected and a music play operation may be performed. That is, for example, if the right function key 152 is pressed a short one time, a music play operation may be performed. If it is pressed a long two times, a forward skip operation may be performed. If the left function key 154 is pressed, a backward skip operation may be performed and music selected.

Further, it is possible to control, for example, a music play/stop operation, a volume increase/decrease operation, a forward/backward skip operation, and/or an interval-repeat-play start/termination point setting operation depending on selection of the left or right function keys 152 or 154 of the left or the right earphone main bodies 151 or 153 during a current music play operation.

In other words, the controller 130 may select a music file stored in the storage unit 155 using the function key. The selected music file is decoded into an audio signal by the decoder 135 and is then output to the left/right earphone main bodies 151 and 153 through the earphone jack 150*a* mounted on the main body 100.

Then, if the function keys 152 or 154 of the earphone main bodies 151 or 153 is selected by a user during a music play operation, the microcomputer 160 recognizes the selection of the function key and informs the controller 130 of the selection, thereby performing a music play control operation through the controller 130. Since the microcomputer 160 stores values regarding, for example, a music play/stop operation, a volume control operation, a skip control operation, a mute/pause operation on the basis of, for example, a pressing, the number of pressings, a degree of pressing time of the two function keys FL and FR, and a current status of a music play operation, the microcomputer 160 discriminates an input signal from the left/right function key 152 or 154 and then informs the controller 130 of the input signal so that a music play control operation may be performed. Further, in certain embodiments, a user may enter a control mode of the left/right function keys using the key input unit 115 to, for example, change a direction of the function keys R→L) (L→R) or to change and confirm functions of the function keys.

In accordance with embodiments of the invention, one or more function keys may be provided on the left and/or right earphone main bodies 151 or 153, and ports of the microcomputer may be assigned in correspondence to the function keys.

Figure 5:
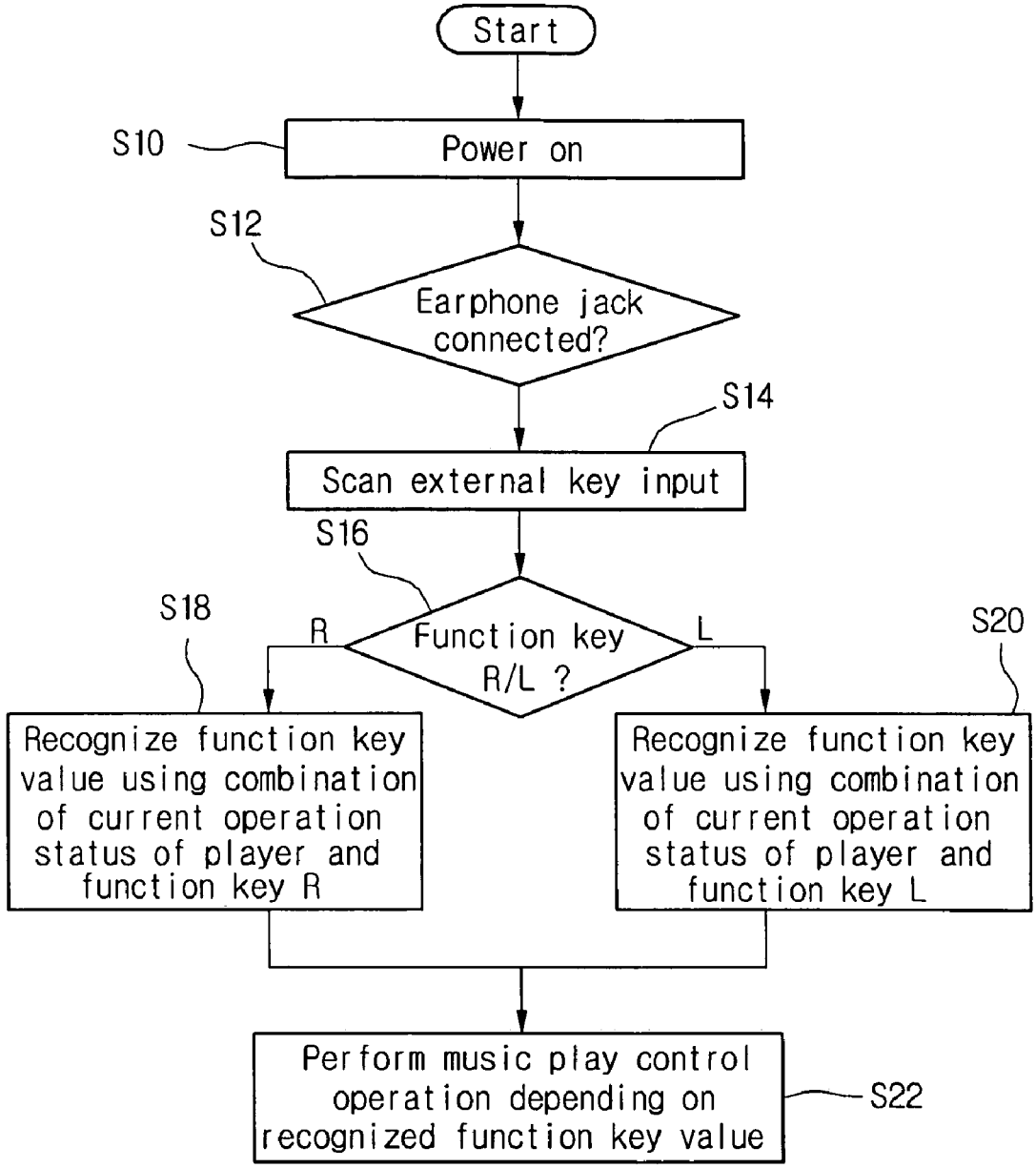
FIG. 5 is a flowchart of a music play control method using at least one earphone function key according to an embodiment of the invention.

FIG. 5 is a flowchart of a music play control method using at least one earphone function key according to an embodiment of the invention. Referring to FIG. 5, a power on state of the music player is first determined, in step S10, and then whether an earphone jack is connected or not is checked, in step S12. If the earphone jack is connected, an input of a function key of external earphone main bodies is scanned, in step S14.

Next, it is determined whether there exists an input from either the left or right function keys of the earphone main bodies by a user, in step S16. A function key value is recognized on the basis of a current operation status of the music player and the function key (the left or the right function key), in steps S18 and S20. A music play control operation of the music player is performed depending on the recognized function key value, in step S22.

That is, the input or not of a key through a function key of the external earphone main bodies, a number of key inputs, and a length of a key input time, for example, are checked using the function keys of the external earphone main bodies, and then a music play/stop operation, a volume increase/decrease (up/down) operation, an interval-repeat-play setting operation and a music skip operation are performed on the basis of a current operation status of the player.

Another music play control method using at least one earphone function key in accordance with an embodiment of the invention will now be described in detail with reference to FIG. 6.

Figure 6:
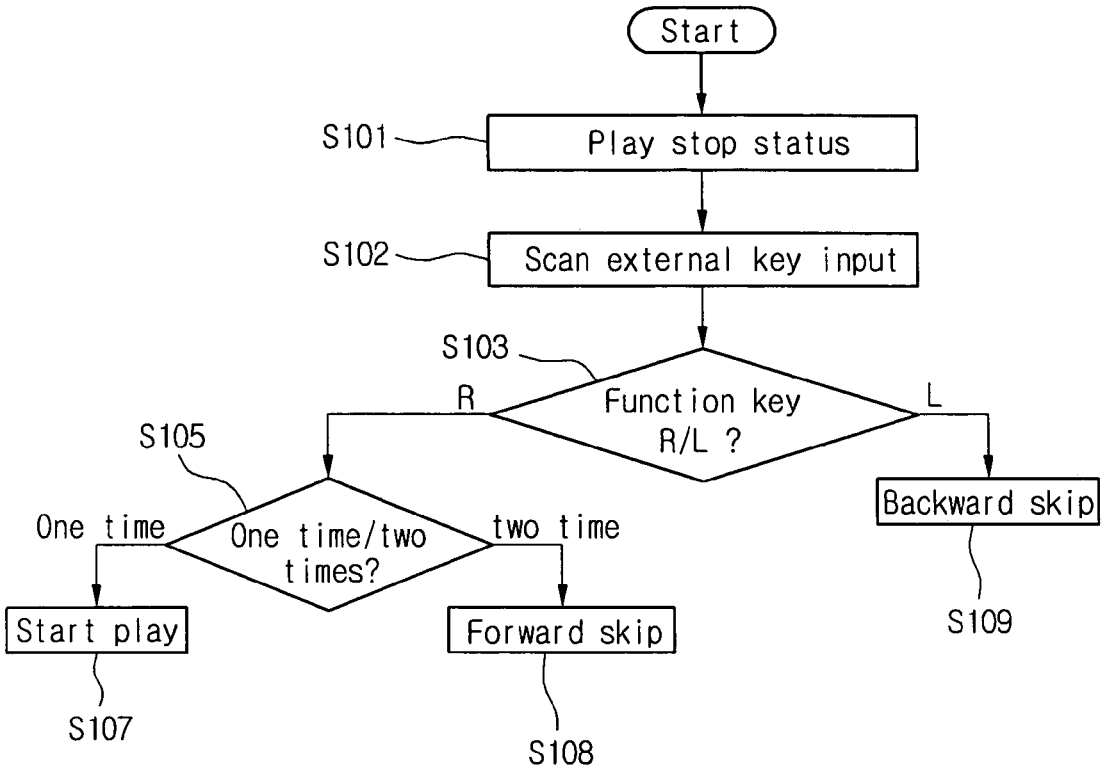
FIG. 6 is a flowchart of a music play or music skip control method using at least one earphone function key according to an embodiment of the invention.

FIG. 6 is a flowchart of a music play or music skip control method using at least one earphone function key according to an embodiment of the invention. Referring to FIG. 6, a play stop status is checked, in step S101. Then, an input of the external function key through the earphone jack is scanned, in step S102, and whether the left or right function key is pressed or not is checked, in step S103.

As a result of the checking, if the right function key is pressed, whether it is pressed a short one time or pressed a short and continuously two times is checked, for example, in step S105. As a result of the checking, if the right function key is pressed a short one time, a music play operation is performed, in step S107. If the right function is pressed short and continuous two times, a forward skip operation is performed, in step S108. As a result of the checking in step S103, if the left function key is selected, a backward skip operation is performed, in step S109.

In another example of a skip operation, if the right function key is pressed for a predetermined period of time, a forward skip operation is performed constantly, while if the left function key is pressed for a predetermined period of time, a backward skip operation is performed constantly. In addition, if either the left or the right function key is selected, a predetermined function is recognized and a music play control operation is performed on the basis of a combination of a value of the selected function key and a current operation status of the player (for example, play stop).

Figure 7:
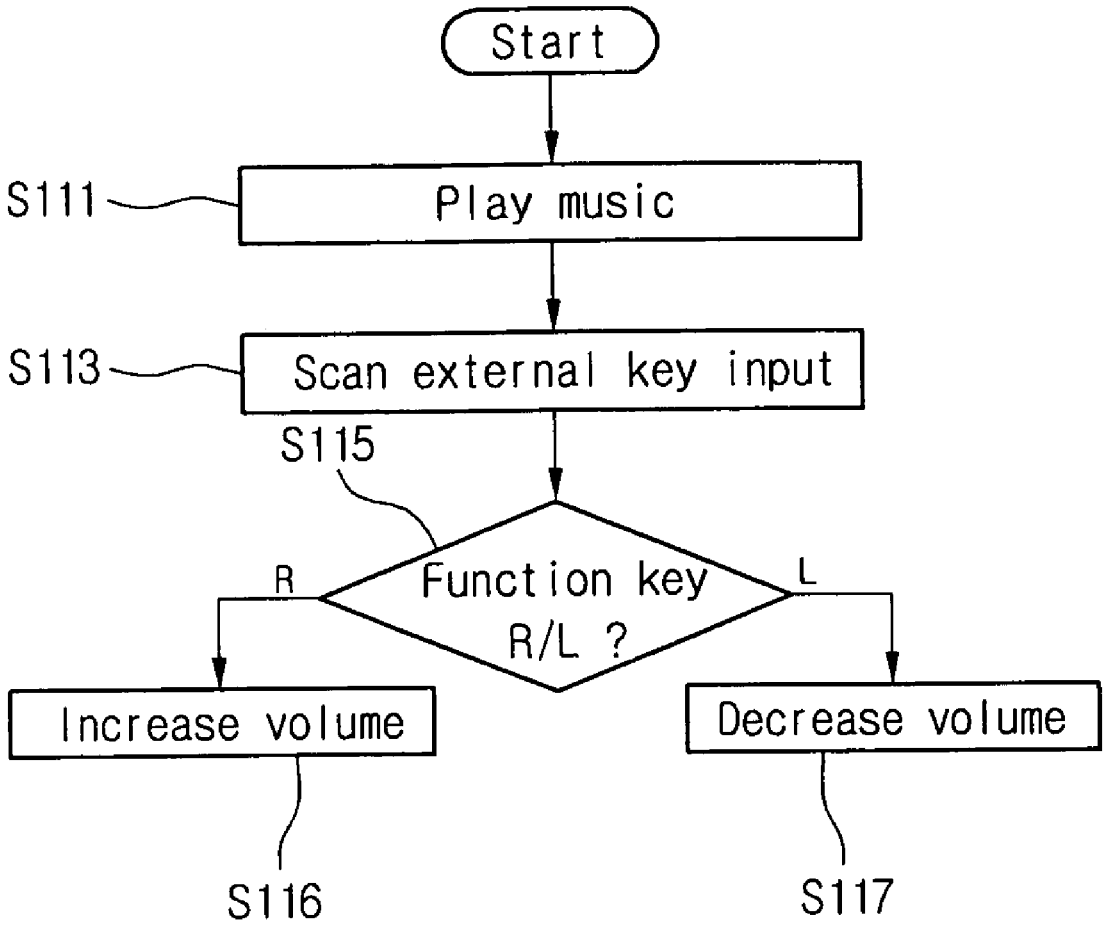
FIG. 7 is a flowchart of a volume control method using at least one earphone function key according to an embodiment of the invention.

FIG. 7 is a flowchart of a volume increase/decrease operation using at least one earphone function key according to an embodiment of the invention. Referring to FIG. 7, a play music operation is checked in step S111, and a key input, for example, a function key input of the earphone main bodies is scanned, in step S113. At this point, if there exists a key input from the left or the right function key of the earphone main bodies, whether it is the left or right function key is checked, in step S115. As a result of step S115, if it is the right function key, a volume is increased, in step S116. If it is the left function key, the volume is decreased, in step S117.

In this embodiment, the volume is increased or decreased on the basis of a combination of a music play status and either the left or right function key.

Figure 8:
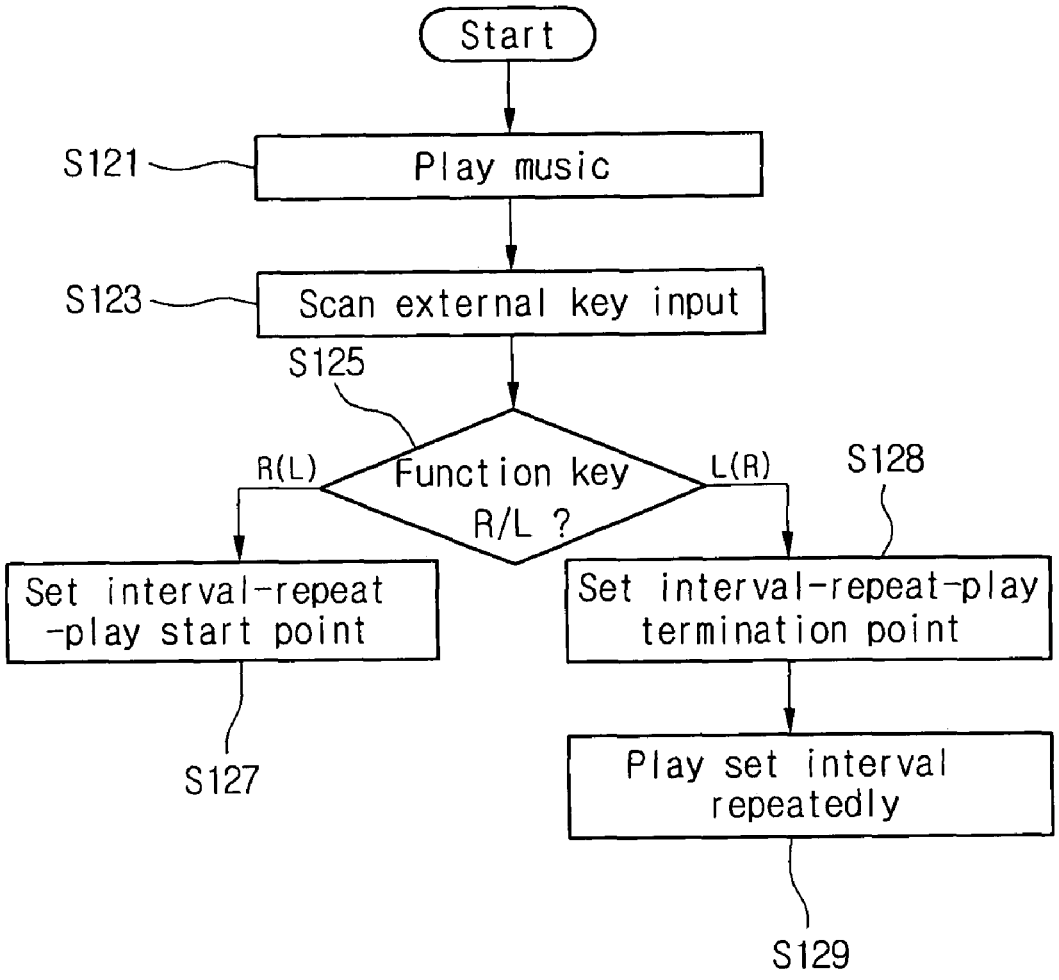
FIG. 8 is a flowchart of an interval-repeat-play control method using at least one earphone function key according to an embodiment of the invention.

FIG. 8 is a flowchart of an interval-repeat-play control method using at least one earphone function key according to an embodiment of the invention. Referring to FIG. 8, a play music operation is checked in step S121, and then a key input, for example, a function key input of the earphone main bodies is scanned, in step S123. If there exists a key input from the left or right function key of the earphone main bodies, whether it is the left or right function key is checked, in step S125.

As a result of step S125, if the right function key is pressed, an interval-repeat-play start point is set, in step S127, and the procedure goes back to step S121 and a music play operation is performed for a predetermined period of time. If the left function key is pressed, an interval-repeat-play termination point is set, in step S128, and the set interval is played repeatedly.

In this embodiment an interval-repeat-play start point and an interval-repeat-play termination point may be set by selecting either the right or left function key. Of course, the left function key may be a key for setting the interval-repeat-play start point and the right function key may be a key for setting the interval-repeat-play termination point.

Figure 9:
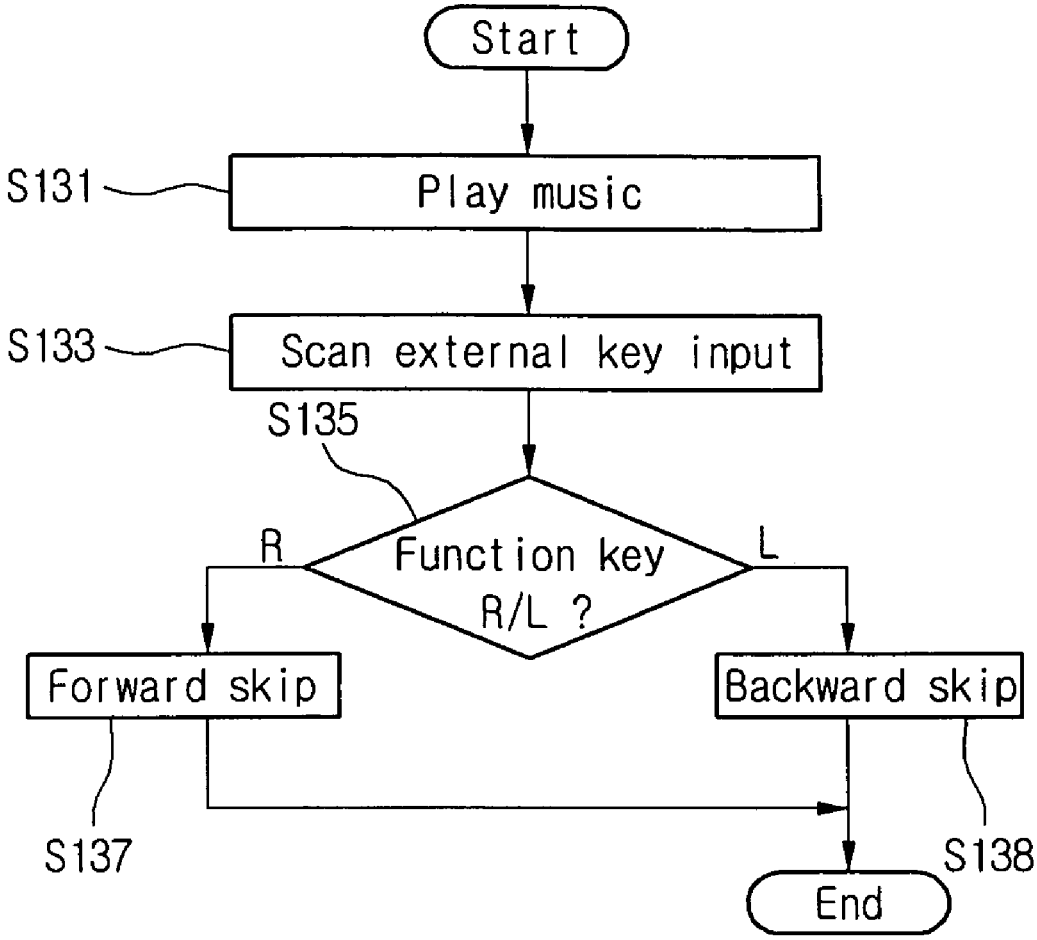
FIG. 9 is a flowchart of a music skip control method using at least one earphone function key according to an embodiment of the invention.

FIG. 9 is a flowchart of a music skip control method using at least one earphone function key according to an embodiment of the invention. Referring to FIG. 9, a music play operation is checked, in step S131, and then a key input, that is, a function key input of the earphone main bodies is scanned, in step S133. If there exists a key input from the left or right function key of the earphone main bodies, whether it is the left or right function key is checked, in step S135.

As a result of step S135, if the right function key is pressed, a forward skip operation is performed, in step S137. If the left function key is pressed, a backward skip operation is performed, in step S138.

It is noted that the functions of the two function keys may be reversed. That is, the right function key may be set to perform a backward skip operation and the left function key may be set to perform a forward skip operation. In other words, the two function keys may be set to have opposite functions with respect to each other.

Figure 10:
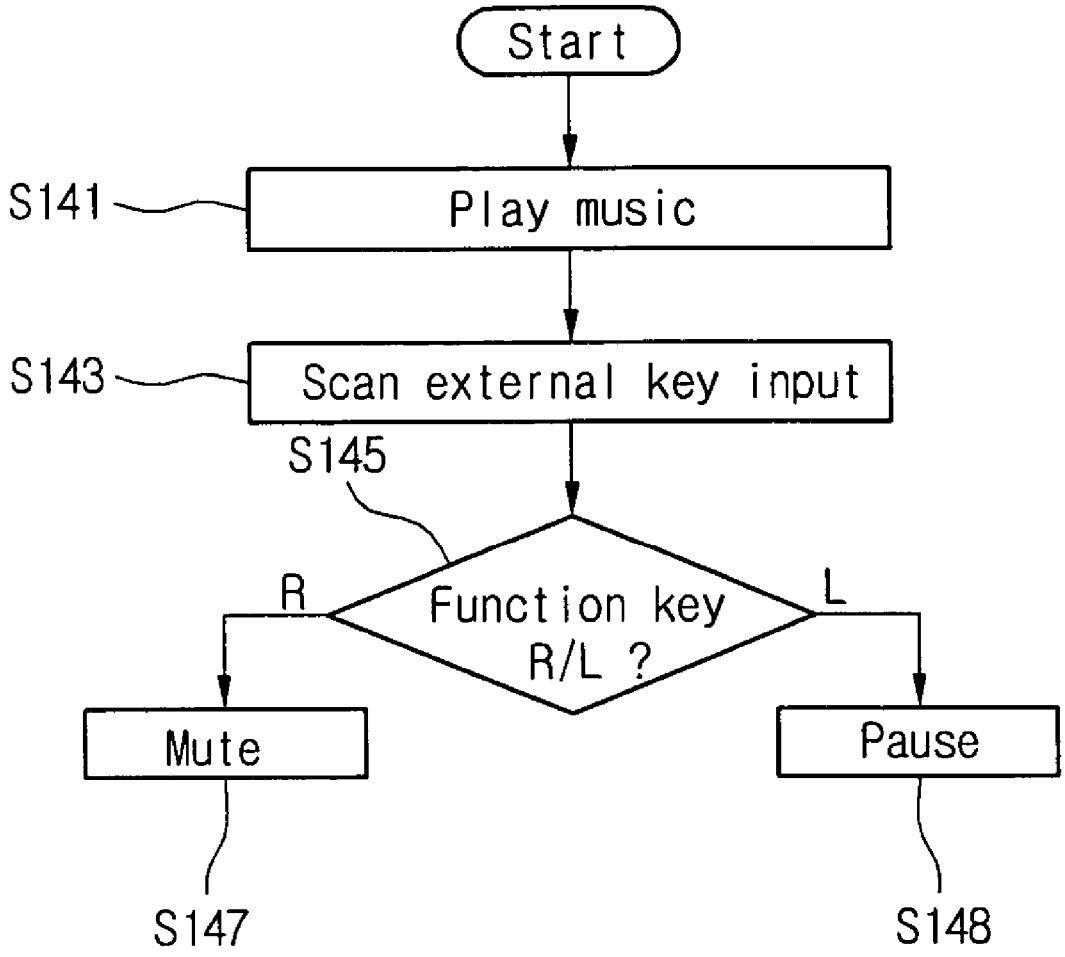
FIG. 10 is a flowchart of a mute or a pause control method using at least one earphone function key according to an embodiment of the invention.

FIG. 10 is a flowchart of a mute or a pause control method using at least one earphone function key according to an embodiment of the invention. Referring to FIG. 10, a music play operation is checked, in step S141, and then a key input, for example, a function key input of the earphone main bodies is scanned, in step S143. If there exists a key input from the left or right function keys of the earphone main bodies, whether it is the left or right function key is checked, in step S145.

As a result of step S145, if the right function key is pressed, a current status is muted, in step S147. If the left function key is pressed, a pause operation is performed, in step S148. Here, if an arbitrary function key is pressed under a mute or a pause status, a music play operation or a music skip operation is performed.

Figure 11:
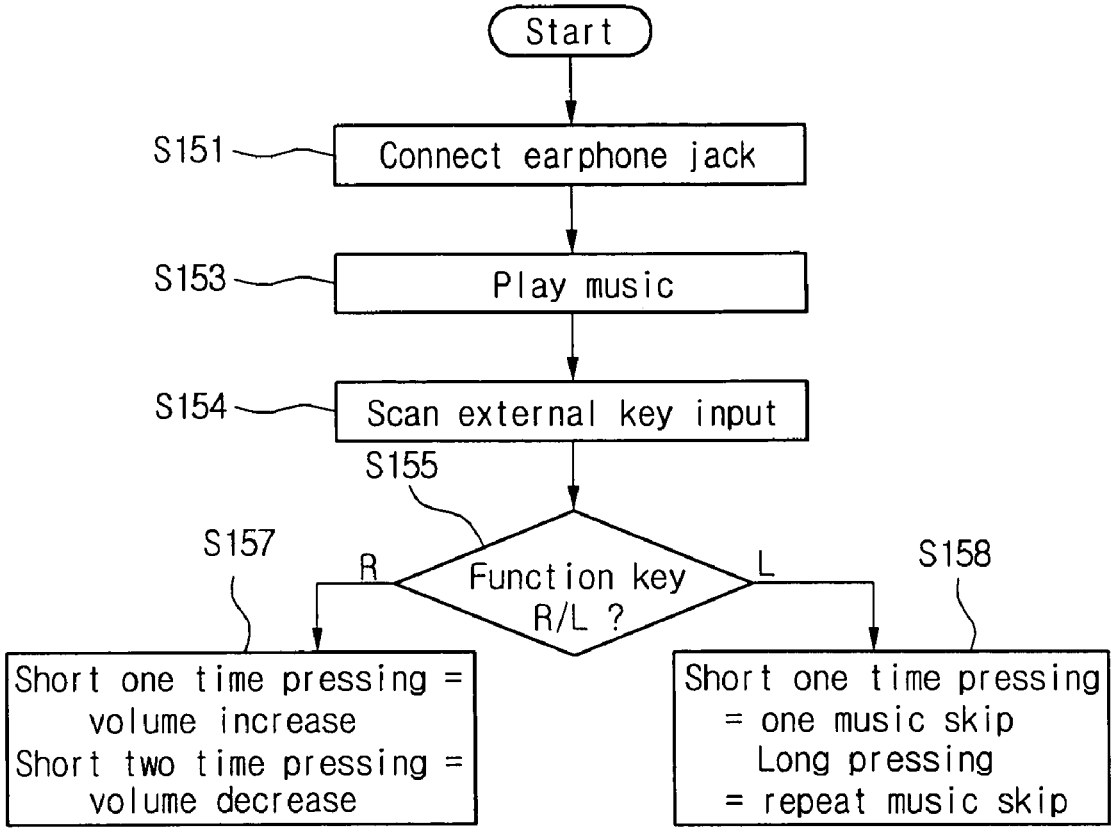
FIG. 11 is a flowchart of a play control method depending on the number of times and the degree of pressing of earphone function keys according to an embodiment of the invention.

FIG. 11 is a flowchart of a volume control and a skip control method using at least one earphone function key according to an embodiment of the invention. In this embodiment, the volume and skip control are based on a number of pressings. Referring to FIG. 11, whether the earphone jack is connected with the main body and a music play operation is being performed is checked in steps S151 and S153. Then, a key input of the function keys of the earphone main bodies is scanned, in step S154. If the function key is pressed, whether it is the left or right function key is checked, in step S155.

As a result of step S155, if the right function key is pressed, for example, a short one time, a volume is increased and if the right function key is pressed, for example, a short two times, the volume is decreased, in step S157. As a result of the checking in step S155, if the left function key is pressed, for example, a short one time, a skip is performed of one unit of music and if the left function key is pressed, for example, a long time, the skip is performed constantly, in step S158.

Figure 12:
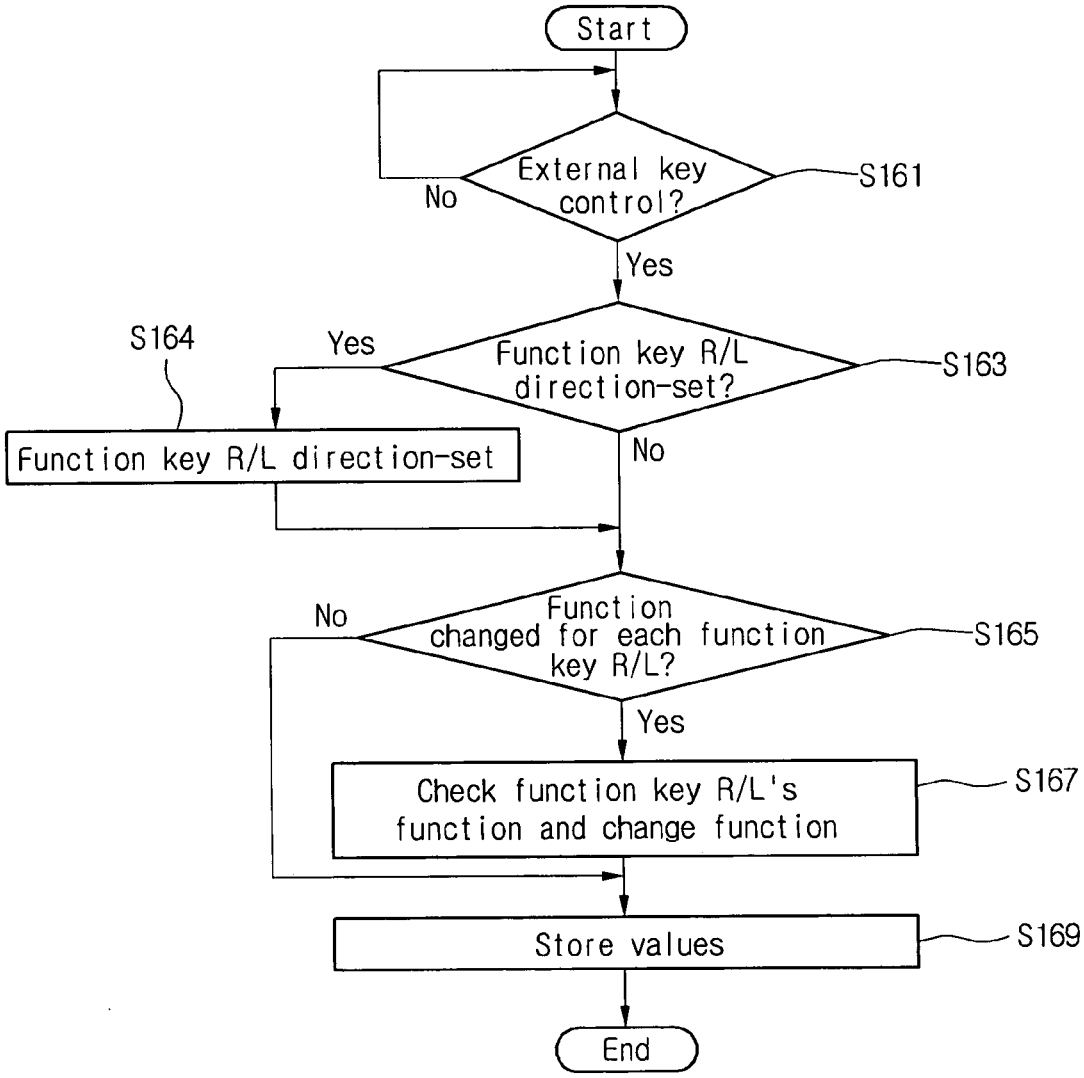
FIG. 12 is a flowchart of a setting method for earphone function keys according to an embodiment of the invention.

FIG. 12 is a flowchart of a setting method for external function keys according to an embodiment of the invention. Referring to FIG. 12, if an external function key control mode is selected by a user, whether it is a direction setting for the left/right function keys is checked, in steps S161 and S163. If it is the direction setting for the left/right function keys, the left function key is switched in its direction into the right function key, and the right function key is switched in its direction into the left function key, in step S164. A user may switch directions of the left/right function keys before and after wearing the earphone.

Whether it is a function change by the left/right function keys is checked, in step S165. If it is the function change, functions of the left/right function keys are confirmed and the function change is performed, in step S167. Such changes are stored, in step S169, and the procedure is terminated.

The music play control apparatus and method according to embodiments of the invention provide at least the following advantages.

The music play control apparatus and method according to embodiments of the invention control one or more operations, such as a play/stop operation, a volume control operation, a music skip operation, interval-repeat-play setting operation, and pause/mute operations by combining left/right function key values of right/left earphones with a parameter of a current status of the player. Further, with the music play control apparatus and method according to embodiments of the invention, it is possible to directly perform a function control using function keys of an external earphone depending on a music play operation of a music player by installing function keys on earphone main bodies. Furthermore, with the music play control apparatus and method according to embodiments of the invention, it is possible for a user to control the external function keys through a control mode on a screen of the portable player, or to perform a key control using an application after connecting the portable music player with a computer.

Also, with the music play control apparatus and method according to embodiments of the invention two function keys may serve for independent functions, respectively, and a combination of the two function keys may correspond to another function. For example, if one function key is pressed with another function key already pressed, another predetermined function may be performed.

Additionally, with the music play control apparatus and method according to embodiments of the invention, left/right function keys of the earphone main bodies may be provided with functions for controlling a music play operation, so that one or more operations, such as a music play/stop operation, a volume increase/decrease operation, a forward/backward skip operation, an interval-repeat-play setting operation are realized, and thus a user can control a music play operation in a convenient manner using the earphone. Further, with the music play control apparatus and method according to embodiments of the invention, because the function keys for a music play operation are provided on the earphones, user convenience is provided, as a music play operation can be directly controlled using the earphones located on the human ears without a remote controller or a main body, which have controlled music play operations up to now. Furthermore, it is possible to control a volume, a skip, or other operations in a simple manner by providing frequently used keys on the earphones.

The foregoing embodiments and advantages are merely exemplary and are not to be construed as limiting the invention. The present teaching can be readily applied to other types of apparatuses. The description of the invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A music player control apparatus for a music player, the apparatus comprising:

an earphone having an earphone jack one end of which is connected with the music player, at least one earphone main body line-connected with the earphone jack and configured to output an audio signal delivered through the earphone jack, and at least one function key installed on the at least one earphone main body of the earphone and to which a key signal for controlling a music play depending on a user selection using the at least one function key installed on the at least one earphone main body is input; and an earphone function controller included in the music player, configured to receive a signal input from the at least one function key of the at least one earphone main body, and perform a music play control operation after recognizing the received signal, wherein the received signal is recognized on the basis of a number of pressings or a pressing time of the at least one function key installed on the at least one earphone main body of the earphone and a current operation status of the music player, wherein when the at least one function key is pressed a short one time, a music play operation is performed and when the at least one function key is pressed a long two times, a forward skip operation is performed, and wherein when another function key of the at least one function key is pressed, a backward skip operation is performed and the music is selected.

2. The apparatus according to claim 1, wherein the at least one function key installed on the at least one earphone main body is connected with one or more port of the earphone function controller.

3. The apparatus according to claim 1, wherein the at least one earphone main body comprises left and right earphone main bodies and at least one function key is installed on each of the left and right earphone main bodies, and wherein the function keys are set to have opposite functions.

4. The apparatus according to claim 1, wherein the at least one earphone main body comprises left and right earphone main bodies and at least one function key is installed on each of the left and right earphone main bodies, and wherein the function keys comprise an inverter key or a toggle key.

5. The apparatus according to claim 1, wherein the at least one earphone main body comprises left and right earphone main bodies and at least one function key is installed on each of the left and right earphone main bodies, wherein a music play/stop and/or a skip control is performed using the function keys installed on the left and right earphone main bodies, wherein an earphone line is in audio communication with the at least one ear phone main body, and wherein the earphone line connects the earphone jack with the earphone main body and includes a signal line, a ground line, and a data line that delivers a signal from the at least one function key.

6. The apparatus according to claim 1, wherein the at least one earphone main body comprises left and right earphone main bodies and at least one function key is installed on each of the left and right earphone main bodies, and wherein a volume increase/decrease and/or a volume mute/pause is performed using the function keys installed on the left and right earphone main bodies.

7. The apparatus according to claim 1, wherein the at least one earphone main body comprises left and right earphone main bodies and if the current operation status of the music player is a play stop status, the earphone function controller controls performing a music play or a skip control operation depending on whether the at least one function key installed on the at least one earphone main body of the earphone is pressed on the left or the right earphone main body.

8. The apparatus according to claim 1, wherein if the current operation status of the music player is in a music play status, the earphone function controller controls performing a forward or a backward skip operation.

9. The apparatus according to claim 1, wherein if the current operation status of the music player is in a music play status, the earphone function controller controls setting an interval-repeat-play start point using a specific one function key installed on the at least one earphone main body of the earphone, setting an interval-repeat-play termination point using another function key after setting the interval-repeat-play start point, and playing a set interval repeatedly at the same time the interval-repeat-play termination point is set.

10. The apparatus according to claim 1, wherein the at least one earphone main body comprises left and right earphone main bodies and if the current operation status of the music player is in a music play status, the earphone function controller controls performing a mute or a pause operation using either of the at least one function key on the left or the right earphone main body.

11. The apparatus according to claim 1, wherein the at least one earphone main body comprises left and right earphone main bodies and the at least one function key comprises at least one function key provided on each of the left and right earphone main bodies and a volume increase/decrease is controlled depending on a number of pressings of one of the function keys, and a music skip or a continuous skip operation is controlled depending on a length of a pressing time of the another of the function keys.

12. The apparatus according to claim 1, wherein the earphone function controller comprises a first controller that receives the signal input from the at least one function key of the at least one earphone main body and recognizes the input signal, and a second controller that performs the music play control operation based on a recognized operation value.

13. The apparatus according to claim 1, wherein the at least one function key is directly installed on the at least one earphone main body of the earphone.

14. The apparatus according to claim 1, wherein the at least one earphone main body comprises left and right earphone main bodies and the at least one function key comprises at least one function key installed on each of the left and right earphone main bodies, wherein when the at least one function key installed on one of the left or right earphone main bodies is pressed a short one time, the music play operation is performed and when the at least one function key installed on the one of the left or right earphone main bodies is pressed a long two times, the forward skip operation is performed, and wherein when the at least one function key installed on the one of the left or right main bodies is pressed, the backward skip operation is performed and the music is selected.

15. An earphone apparatus for a music player, the earphone apparatus comprising:

at least one earphone main body of an earphone, the at least one earphone main body comprising at least one function key configured to communicate with a controller of the music player, wherein the at least one function key is installed on the at least one earphone main body of the earphone;

an earphone line in audio communication with the at least one ear phone main body; and an earphone jack connected to the earphone line, wherein the earphone line connects the earphone jack with the earphone main body and includes a signal line, a ground line, and a data line that deliver a signal from the at least one function key, wherein the delivered signal is recognized on the basis of a number of pressings or a pressing time of the at least one function key installed on the at least one earphone main body of the earphone and a current operation status of the music player, wherein when the at least one function key is pressed a short one time, a music play operation is performed and when the at least one function key is pressed a long two times, a forward skip operation is performed, and wherein when another function key of the at least one function key is pressed, a backward skip operation is performed and the music is selected.

16. The earphone apparatus according to claim 15, wherein the at least one function key is at least one of a music play/stop function key, a volume increase/decrease function key, an interval-repeat-play setting function key, or a music skip function key.

* * * * *